US005639359A

United States Patent [19]

Piaskowski et al.

[11] Patent Number: 5,639,359

[45] Date of Patent: Jun. 17, 1997

[54] ELECTROSTATIC PRECIPITATOR DISCHARGE RAPPER ANVIL

[75] Inventors: Edward J. Piaskowski, Massillon; Robert E. Snyder, North Canton, both of Ohio

[73] Assignee: The Babcock & Wilcox Company, New Orleans, La.

[21] Appl. No.: 539,571

[22] Filed: Oct. 5, 1995

[51] Int. Cl.[6] ..... B03C 3/76

[52] U.S. Cl. ..... 204/279; 96/28; 96/29; 96/32; 96/33; 96/35; 96/37; 96/38

[58] Field of Search ..... 204/279; 96/28, 96/29, 32, 33, 35, 37, 38

[56] References Cited

U.S. PATENT DOCUMENTS 5,051,119 9/1991 Lind ..... 96/38

FOREIGN PATENT DOCUMENTS 609546 6/1978 U.S.S.R. ..... 96/35

1421995 1/1976 United Kingdom ..... 96/35

*Primary Examiner*—Arun S. Phasge

*Attorney, Agent, or Firm*—Daniel S. Kalka; Robert J. Edwards

[57] ABSTRACT

An anvil arrangement for receiving rapper impacts and transmitting them to a discharge electrode of a precipitator has an electrode tube made of deformable material, having an open end and forming part of the discharge electrode. An anvil having a head and a shank is connected to the head and the shank has a size for insertion into the open end of the tube. The head is larger than the tube for engagement against the open end of the tube. The shank has a recess therein and at least one crimp in the tube near the open end thereof and in the vicinity of the recess of the shank for retaining the anvil to the tube. An alternate embodiment receives the electrode tube therein and engages the tube with an angled groove.

9 Claims, 4 Drawing Sheets

ELECTROSTATIC PRECIPITATOR DISCHARGE RAPPER ANVIL

BACKGROUND OF THE INVENTION

1. Field of the Invention

The present invention relates, in general, to rappers for the discharge electrodes of a precipitator and, in particular, to a new and useful anvil and anvil arrangement for such rappers.

2. Description of the Invention

Electrostatic precipitators, used for the collection of dusts and flyash from exhaust gas of boilers and other combustion devices, utilize a series of alternating collection plates and discharge electrodes. The particulate in the exhaust gas is electrically charged by the discharge electrodes, causing the dust particles to migrate to and adhere to the collection plates. The dust is periodically removed by rapping the collection surface to dislodge the dust which falls into collecting hoppers for removal. The discharge electrodes also collect some dust which must be periodically removed to permit optimum performance. This invention deals with the anvils that are attached to the discharge electrodes.

The anvil is a mechanical device which absorbs impact from a rapping device and distributes the rapping force into the discharge electrodes for the purpose of removing ash deposits. The impact may be generated by any number of devices such as tumbling hammers or electromagnetic driven rods.

There is an abundance of different styles of anvils used on electrostatic precipitator discharge electrodes. Some are castings or forgings while others are welded assemblies. In general, the anvils are held onto the discharge electrode by either bolting, pinning or welding.

FIG. 1 illustrates a typical discharge electrode (30) being rapped by a tumbling hammer (32). The discharge electrode is comprised of electrode tubes (12) and electrode elements (13).

As shown in FIG. 1, a tumbling hammer (32) is pivotally mounted to an arm (34) fixed to a tumbling hammer shaft (36) journaled to a frame of the precipitator. When shaft (36) rotates, the swinging hammer (32) repeatedly strikes the prior art anvil (38) which is connected by known means to the frame of the electrodes of the precipitator.

SUMMARY OF THE INVENTION

An object of the present invention is to improve the anvil used in rapping devices for the discharge electrode of a precipitator, which facilitates an inexpensive and effective attachment between the electrode, in particular, the electrode tube, and the anvil, while maximizing transfer of force between the anvil and the tube.

Accordingly, an object of the invention is to provide an anvil arrangement for receiving rapper impacts and transmitting them to a discharge electrode of a precipitator, comprising: an electrode tube made of deformable material, having an open end and forming part of the discharge electrode; an anvil having a head and a shank connected to the head, the shank having a size for insertion into the open end of the tube, the head being larger than the tube for engagement against the open end of the tube, the shank having a recess therein; and at least one crimp in the tube near the open end thereof and in the vicinity of the recess of the shank for retaining the anvil to the tube.

A further object of the invention is to provide a method for attaching an anvil to an electrode tube which comprises inserting the shank of the anvil into the open end of the tube and crimping the tube over a recess of the anvil shank for retaining the anvil to the tube.

Still a further object of the invention is to provide anvil arrangement for receiving rapper impacts and transmitting them to a discharge electrode of a precipitator, comprising:

an electrode tube made of a deformable material, having an open end and forming part of the discharge electrode; and an anvil having a head with a side wall defining a bore, a base of the cavity further having a groove extending angularly into the side wall, the bore of the anvil being constructed to receive the electrode tube with the groove of the anvil deforming and engaging the electrode tube.

Yet a further object of the invention is to provide at least two anvil arrangement, and attachment method which are simple in design, rugged in construction and economical to utilize.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
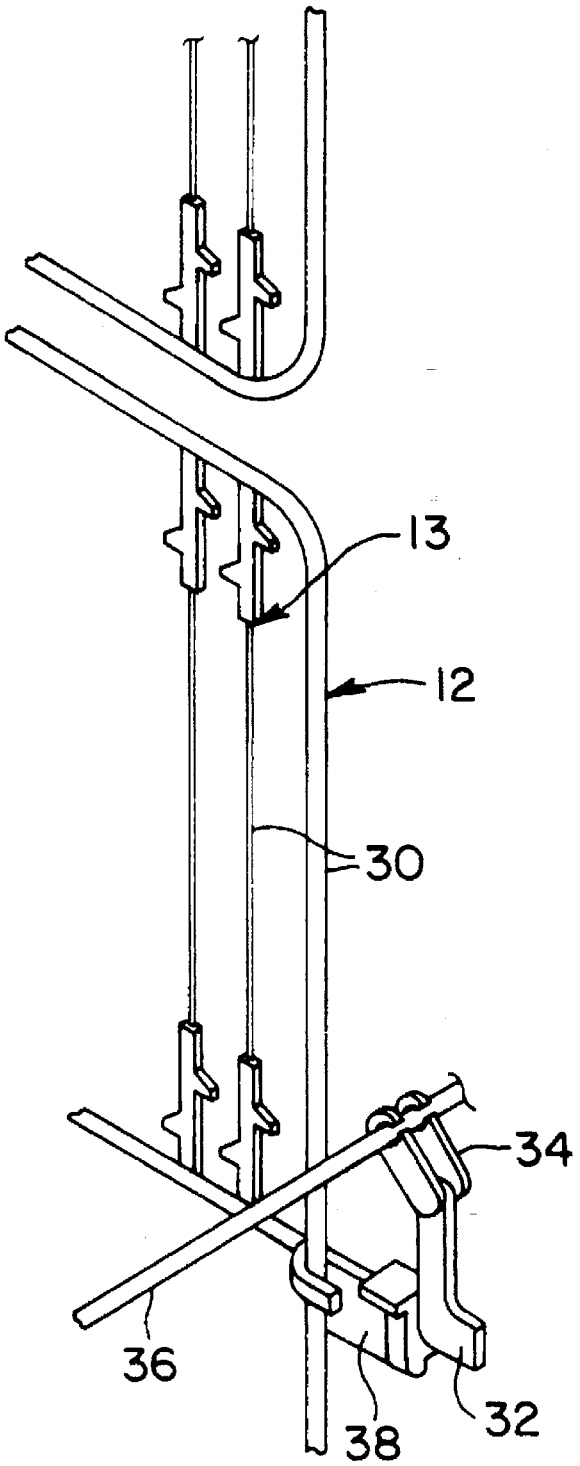
FIG. 1 PRIOR ART
FIG. 1 is a schematic representation of a known rapper arrangement for electrostatic precipitators.

Referring to the drawings in particular, the invention embodied in FIGS. 2–5, includes an anvil arrangement for an electrode tube of a precipitator discharge electrode.

Figure 2:
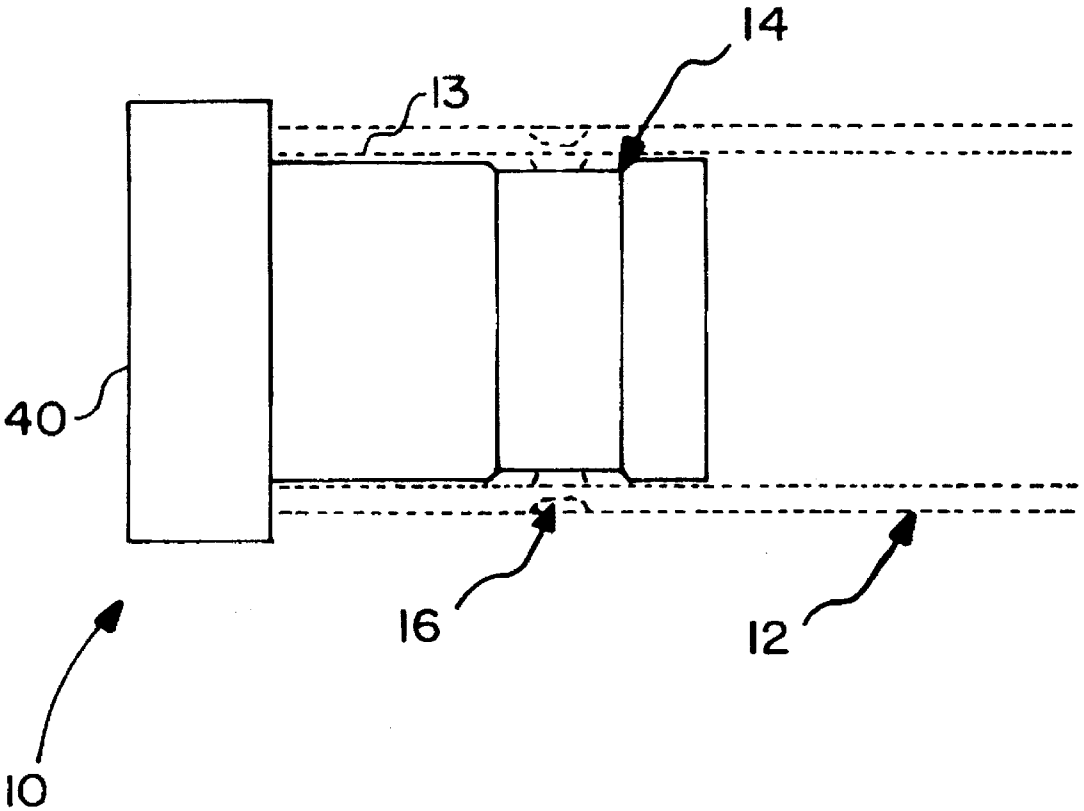
FIG. 2 is a side elevational view of an anvil according to the present invention.
Figure 3:
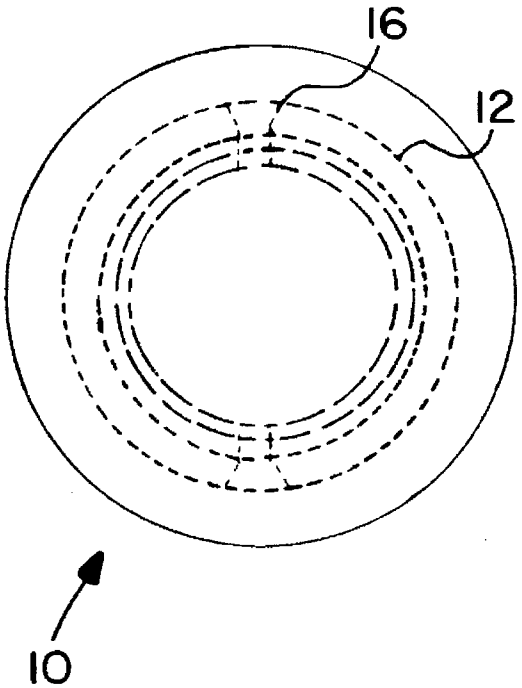
FIG. 3 is an end view of the anvil of FIG. 2.

FIGS. 2 and 3 illustrate electrostatic discharge electrode anvil (10) which is held onto the discharge electrode by mechanical deformation of the electrode tube (12) into a recess (14) in the anvil (10). The actual size of the anvil (10) is dependent upon the discharge electrode tube (12) size. The anvil size can vary from 1" to 4" in diameter and from 1" to 8" or greater in length. The recess (14) is normally 1/32" to 1/8" deep to accommodate the mechanically deformed electrode material. Recess 14 is provided along the length of shank 13 extending from the rear face of the anvil (10). Portions of shank 13 extend outwardly from both sides of recess 14 so that when crimp 16 is formed in tube 12 anvil 10 will not fall from the end of tube 12 even after long term and repeated uses of the rapper mechanism. Tube diameter of the electrode tube (12) ranges from 1" to 2" and thickness from 18 gauge to 3/16"

The electrode is mechanically deformed at 16 by using a crimping tool after insertion of the anvil. The crimping tool size is adjusted to accommodate the variations in anvil size. The anvil (10) may be either shop or field attached.

There are any number of different tools that can be fashioned to perform the crimping operation.

Figure 4:
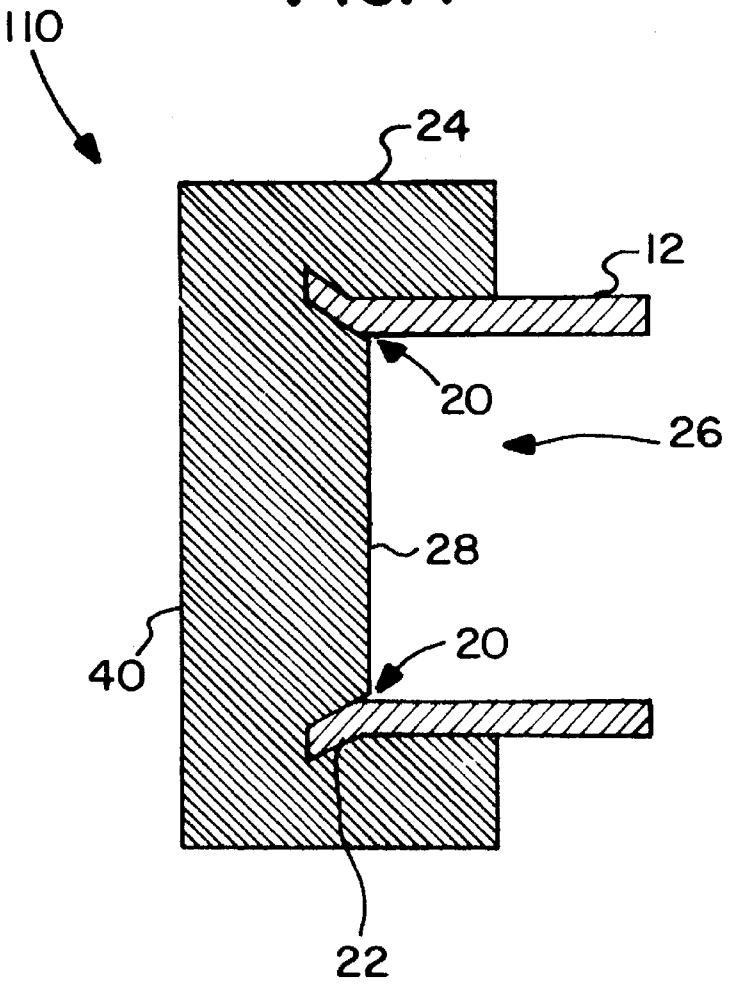
FIG. 4 is a side sectional view of another embodiment of an anvil according to the present invention.
Figure 5:
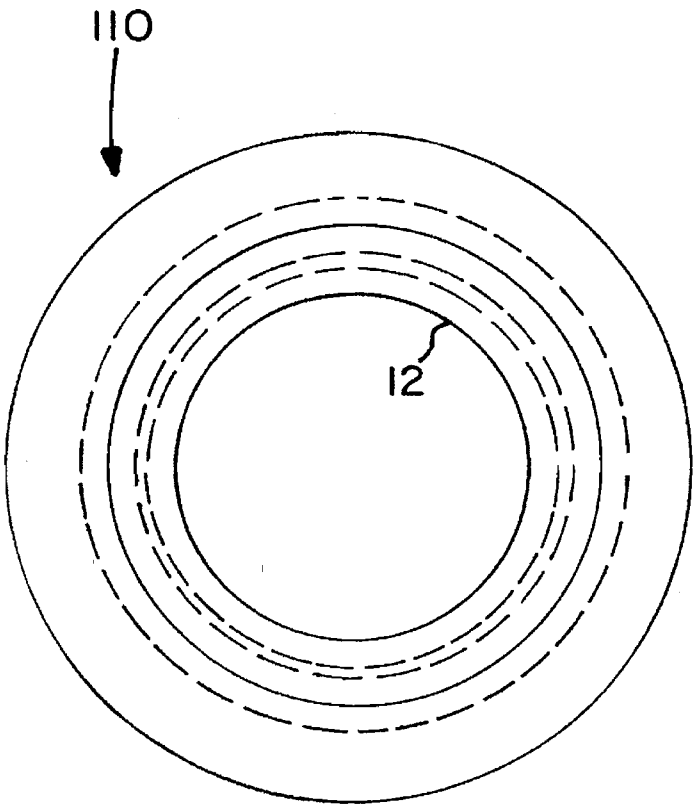
FIG. 5 is an end view of the anvil of FIG. 4.

FIGS. 4 and 5 illustrate a female style electrostatic discharge electrode anvil (110) which is held onto the discharge electrode tube (12) by mechanical deformation of the electrode tube into an angled groove (20) inside the anvil. The actual size of anvil (110) is dependent upon the discharge electrode tube size. The anvil size can vary from 1" to 4" in diameter and from 1" to 6" or greater in length. The angled groove (20) is normally ⅛" to ¼" deep and 3/32" to 3/16" wide to accommodate the mechanically deformed electrode material (22). The angle of the groove may differ from the inner to outer edge to optimize capture. These angles may vary from 10 to 40 degrees or greater from the vertical axis depending upon the tube size and wall thickness.

The anvil (110) has a side wall (24) that engages the electrode tube (12) on its outer diameter (O.D.). The side wall (24) extends beyond the head of the anvil to define a bore (26) with a base (28) of the bore (26). The base (28) has the angled grooves (20) which the base (28) deforms the electrode material (22) into a secure fit.

The electrode is mechanically deformed by rapping or pressing the anvil onto the tube. The tube end is flared (mechanically deformed) to the angles of the anvil groove thereby capturing the anvil without any other mechanical means necessary. Subsequent rapping during operation continues to deform the tube metal to increase the strength of the mechanical bond. The anvils 10 or 110 may be either shop or field attached.

Figure 6:
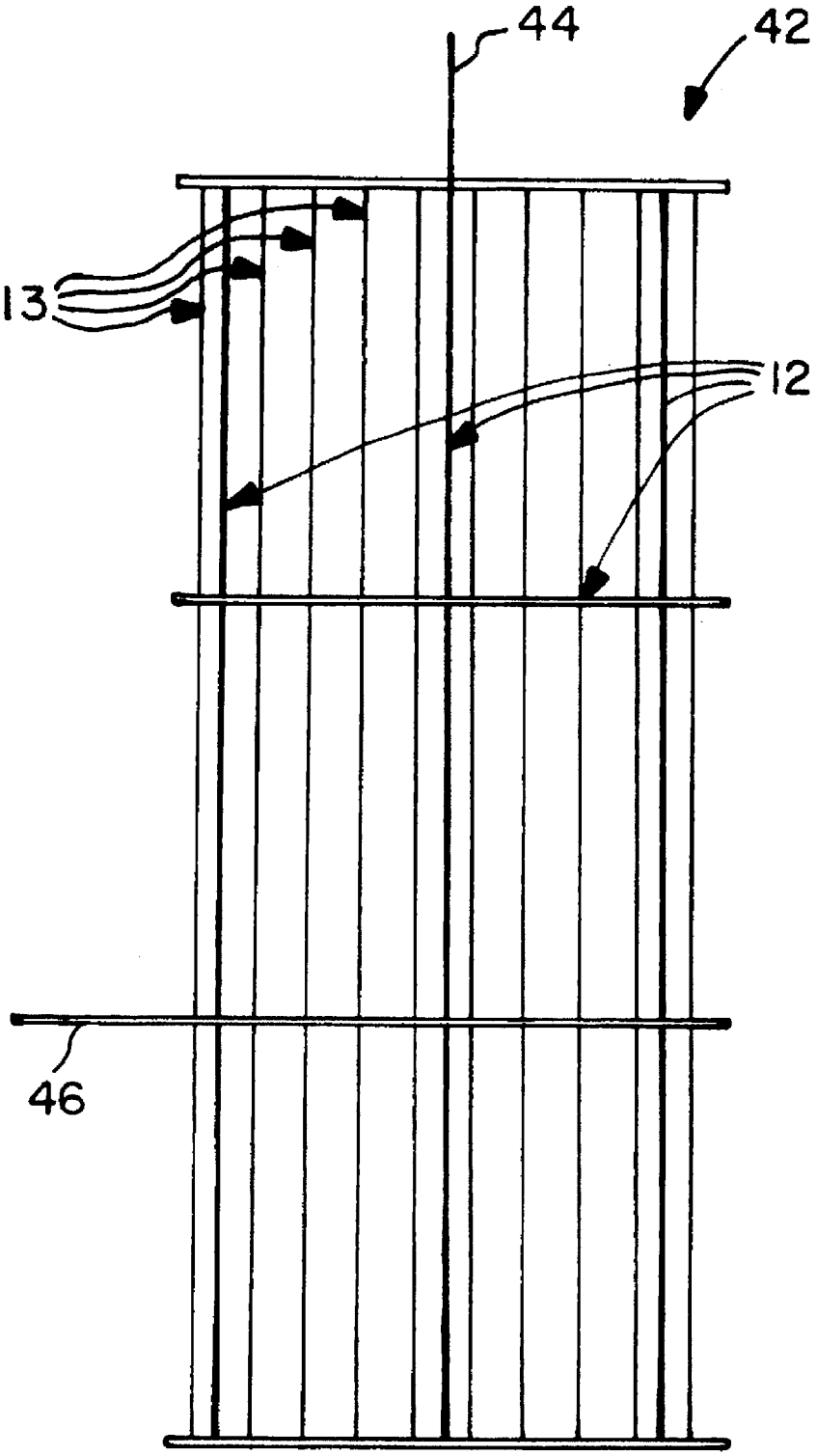
FIG. 6 is a side elevational view of one type of discharge electrode suitable for the present invention.

Both the male and female style of anvils may be used in the horizontal or vertical arrangement as shown in FIG. 6. FIG. 6 shows a discharge electrode (42) which includes a plurality of electrode tubes (12). One or more tubes (12) may be extended either in a vertical arrangement or horizontal arrangement (46), or both. The anvils (10, 110) according to the present invention are employed on these tubes as described previously herein.

As shown in FIGS. 2–5, anvils (10, 110) each have a large diameter head 40 which has a front surface to receive the rapping energy of the rapper hammer, and a rear surface for engagement in or around the open end of the electrode tube 12.

The design according to the present invention includes the following features:

a. Bearing Transfer Surface—The point of contact between the anvil and the discharge electrode is a bearing surface. This is the ideal type of contact for transfer of impact force.

b. Mechanical Indention or Deformation Attachment Method —The mechanical indention or deformation method of attachment requires no drilling or other machining of the electrode. No welding, pins or bolts are required to attach the anvil. This is a lower cost design.

A welded attachment method induces thermal stresses into the electrode and anvil. The mechanical indention or deformation method produces no added thermal stress.

A bolted and or pinned method reduces the discharge electrode metal area thereby reducing the strength available to resist failure from repeated rapping. The mechanical indention or deformation method produces no metal area reduction.

c. Energy Absorbing—The mass of the anvil may be varied by changing the anvil diameter and strike surface thickness and diameter. As the size of the discharge electrode increases, the rapping energy needed also increases increasing the mass of the anvil has been found to improve the distribution of the rapping force into the discharge electrode.

d. The design of anvil described herein is much less prone to failure at its attachment. The crimp or flare allows the anvil to float and not fall off. Whereas, a weld or bolt or pin could fail allowing the anvil to fall off and such failure may impede the transfer or rapping force.

While specific embodiments of the invention have been shown and described in detail to illustrate the application of the principles of the invention, it will be understood that the invention may be embodied otherwise without departing from such principles.

What is claimed is:

1. An anvil arrangement for receiving rapper impacts and transmitting them to a discharge electrode of a precipitator, comprising:

an electrode tube made of deformable material, having an open end and forming part of the discharge electrode;

an anvil having a head and a shank connected to the head, the shank having a size for insertion into the open end of the tube, the head being larger than the tube for engagement against the open end of the tube, the shank having a recess therein; and at least one crimp in the tube near the open end thereof and in the vicinity of the recess of the shank for retaining the anvil to the tube.

2. An arrangement according to claim 1, wherein the head and shank of the anvil are cylindrical, the recess being annular.

3. An anvil arrangement according to claim 2, wherein the crimp is conical.

4. An arrangement according to claim 2, wherein the crimp is a truncated conical shape.

5. An arrangement according to claim 1, wherein the tube includes only a single crimp extending into the recess of the shank.

6. An arrangement according to claim 5, wherein the recess is annular around the shank, the shank being cylindrical.

7. An anvil arrangement for receiving rapper impacts and transmitting them to a discharge electrode of a precipitator, comprising:

an electrode tube made of a deformable material, having an open end and forming part of the discharge electrode; and an anvil having a head with a side wall defining a bore, a base of the bore further having a groove extending angularly into the side wall, the bore of the anvil being constructed to receive the electrode tube with the groove of the anvil deforming and engaging the electrode tube.

8. An arrangement according to claim 7, wherein the anvil is cylindrical.

9. An arrangement according to claim 8, wherein the groove extends angularly outwards towards the side wall.

* * * * *